US007082928B2

(12) United States Patent
Fritsch et al.

(10) Patent No.: US 7,082,928 B2
(45) Date of Patent: Aug. 1, 2006

(54) METHOD FOR ADJUSTING THE DURATION OF FUEL INJECTION THROUGH AN INJECTION VALVE

(75) Inventors: Jürgen Fritsch, Regensburg (DE); Treerapot Kongtoranin, Bangkok (TH); Diego Valero-Bertrand, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/255,276

(22) Filed: Oct. 21, 2005

(65) Prior Publication Data

US 2006/0037586 A1 Feb. 23, 2006

Related U.S. Application Data

(63) Continuation of application No. PCT/EP2004/50454, filed on Apr. 6, 2004.

(51) Int. Cl.

| | |
|---|---|
| ***F02D 41/34*** | (2006.01) |
| ***F02D 41/40*** | (2006.01) |
| *F02N 63/00* | (2006.01) |
| *F02D 41/04* | (2006.01) |

(52) U.S. Cl. ..... 123/478; 123/447; 123/464

(58) Field of Classification Search ..... 123/299, 123/300, 302, 305, 445, 446, 447, 456, 464, 123/467, 470, 472, 478, 480, 490, 491, 525, 123/527; 361/152

See application file for complete search history.

(56) References Cited

U.S. PATENT DOCUMENTS

| | | | | |
|---|---|---|---|---|
| 5,542,392 | A * | 8/1996 | Povinger | 123/480 |
| 5,579,739 | A * | 12/1996 | Tuckey et al. | 123/467 |
| 5,865,158 | A * | 2/1999 | Cleveland et al. | 123/478 |
| 5,906,188 | A | 5/1999 | Nakamura et al. | 123/464 |

(Continued)

FOREIGN PATENT DOCUMENTS

| | | | |
|---|---|---|---|
| DE | 19543538 | | 11/1995 |
| DE | 19841533 | | 9/1998 |
| EP | 0 896 144 | A2 | 8/1998 |
| JP | 7-197840 | A * | 8/1995 |
| JP | 2003-90237 | A * | 3/2003 |

OTHER PUBLICATIONS

International Search Report; PCT/EP2004/050454; 5 pp.

(Continued)

*Primary Examiner*—Willis R. Wolfe, Jr.
(74) *Attorney, Agent, or Firm*—Baker Botts L.L.P.

(57) ABSTRACT

A method for adjusting the duration of fuel injection through an injection valve is performed according to the temperature of the injected fuel. When in an operational mode, fuel is injected by the injection valve into a combustion chamber and non-injected fuel is discharged as a leakage flow. Fuel is supplied to the injection valve at a first high pressure. A first temperature of the fuel in the leakage flow and the pressure of the fuel in the fuel pressure store are measured. A second temperature of the fuel which is to be injected into the injection valve is determined according a function with the first temperature of the fuel in the leakage flow and the first pressure, and the duration of the fuel injection is adjusted according to the second temperature.

12 Claims, 1 Drawing Sheet

U.S. PATENT DOCUMENTS

| | | | | |
|---|---|---|---|---|
| 6,196,185 | B1 * | 3/2001 | Jingu | 123/302 |
| 6,408,825 | B1 * | 6/2002 | Enoki et al. | 123/467 |
| 6,494,190 | B1 * | 12/2002 | Cohen | 123/525 |
| 6,823,834 | B1 * | 11/2004 | Benson et al. | 123/299 |

OTHER PUBLICATIONS

English Translation of Written Opinion of International Searching Authority; PCT/EP2004/050454; 2 pp.

* cited by examiner

METHOD FOR ADJUSTING THE DURATION OF FUEL INJECTION THROUGH AN INJECTION VALVE

CROSS-REFERENCE TO RELATED APPLICATIONS

This application is a continuation of co-pending International Application No. PCT/EP2004/050454 filed Apr. 6, 2004, which designates the United States of America, and claims priority to German application number 10318647.6 filed Apr. 24, 2003, the contents of which are hereby incorporated by reference in their entirety.

TECHNICAL FIELD

The invention relates to a method for adjusting the duration of fuel injection through an injection valve and an injection system with an injection valve.

BACKGROUND

In direct injection systems the fuel is injected from a fuel pressure accumulator through injection valves into the combustion chambers of the internal combustion engine. In order to optimize the control of the injection process, the fuel temperature of the injected fuel, i.e. the temperature of the fuel in the injection valve, must be known as accurately as possible. Toward that end reference is generally made to the temperature of the fuel in the fuel pressure accumulator as an approximation.

The physical characteristics of the fuel, such as for example the density, the viscosity, the elasticity, the sound propagation velocity in the fuel, etc., are dependent on the temperature of the fuel. The physical characteristics of the fuel determine how the entire injection process proceeds, as well as the embodiment of the entire injection system. Knowledge of the fuel temperature is therefore used to adjust the parameters relevant to the injection process in order to achieve optimal injection and combustion.

SUMMARY

The object of the present invention is to provide a method for determining the temperature of the injected fuel. It is a further object of the invention to provide an injection system by means of which the temperature of the injected fuel can be determined.

This object can be achieved by a method for adjusting the duration of fuel injection through an injection valve (4) as a function of the temperature of the injected fuel, wherein the method comprises the steps of, in an operational mode, injecting fuel by the injection valve (4) into a combustion chamber and discharging non-injected fuel as a leakage flow, wherein fuel is supplied to the injection valve (4) at a first high pressure, measuring a first temperature of the fuel in the leakage flow and the pressure of the fuel in the fuel pressure accumulator (3), determining a second temperature of the fuel in the injection valve (4) which is to be injected according to a function with the first temperature of the fuel in the leakage flow and the first pressure, and adjusting the duration of injection as a function of the second temperature.

The second temperature can further be determined as a function of at least one of the further factors from the group consisting of: speed of an internal combustion engine into which the injection valve is introduced; amount of injected fuel; number of injections; time-dependent transient behavior of the temperature; coolant temperature of the internal combustion engine; ambient temperature; and heat radiation balance of the internal combustion engine. The second temperature can also be determined by reading a temperature value from an engine characteristics map at least according to the first pressure and according to the first temperature of the fuel. The capacity of the piezo actuator can be measured, wherein a third temperature of the piezo actuator can be determined from the capacity and the first pressure, wherein the third temperature is taken into account when the second temperature is determined.

The object can also be achieved by an injection system having an injection valve (4), the system comprising a piezo actuator to which fuel is supplied at a pressure from a fuel pressure accumulator (3), and a control unit (5) for adjusting the duration of injection of the injection valve (4), so that the amount of fuel injected is determined, with the injection valve (4) discharging non-injected fuel to a leakage line (7), wherein the control unit (5) is connected to a temperature measuring unit (8) for measuring the temperature of the fuel in the leakage line (7) and to a pressure measuring unit (6) for measuring the pressure in the fuel pressure accumulator (3), wherein the control unit (5) determines a temperature of the fuel in the injection valve (4) which is to be injected according to a function with the temperature of the fuel in the leakage line (7) and with the pressure in the fuel pressure accumulator (3) and the duration of injection is set as a function of the temperature of the fuel to be injected.

According to a first aspect of the present invention, there is provided a method for adjusting the duration of injection when injecting fuel through an injection valve as a function of the temperature of the injected fuel. In an operational mode, fuel is injected by the injection valve into a combustion chamber and a portion of the non-injected fuel is discharged as a leakage flow due to the control movement of the injection valve. Fuel is supplied to the injection valve at a first high pressure. A first temperature of the fuel in the leakage flow and the pressure of the fuel in the fuel pressure accumulator are measured. A second temperature of the fuel in the injection valve and which is to be injected is determined according to a function with the first temperature of the fuel in the leakage flow and the first pressure. The duration of the fuel injection of the injection valve is adjusted according to the second temperature.

The advantage of the method according to the invention is that the temperature does not have to be measured in the fuel pressure accumulator or in the injection valve, but instead only the temperature of the fuel in the leakage flow is measured. This is simpler, as a temperature measuring unit for measuring the fuel temperature in the fuel pressure accumulator or in the injection valve can be dispensed with and in its place the temperature measuring unit is used only in the leakage flow. Since the fuel in the leakage flow is essentially not under pressure, it is easier to provide a temperature measuring unit there which, due to the lower pressure loading, has a longer life. As it is known that the fuel in the leakage flow is essentially not under pressure, i.e. that the pressure in the leakage flow essentially corresponds to atmospheric pressure, the temperature of the fuel in the fuel pressure accumulator can be deduced from the pressure difference and the temperature of the fuel in the leakage flow. It is assumed therefrom that the temperature of the injected fuel corresponds approximately to the temperature in the fuel pressure accumulator.

The temperature of the fuel in the leakage flow is markedly higher than the temperature of the fuel in the fuel pressure accumulator due to the fact that with fluids such as fuel an increase in temperature results from a lowering of the pressure.

Moreover, the temperature difference between the fuel pressure accumulator and the leakage flow is also affected by the flow rates of the fuel flow into the injection valve, the amount injected and the backflow. The flow rates depend on the number of injection processes, the speed of the internal combustion engine and component characteristics and tolerances. Additionally, the temperature difference between the fuel in the fuel pressure accumulator and the fuel in the leakage flow is affected by heat radiation and cooling effects. For this reason it should preferably be provided that the second temperature be determined according to at least one of the following further parameters: speed of the internal combustion engine in which the injection valve is located, amount of injected fuel, number of injections, coolant temperature of the internal combustion engine, ambient temperature and heat radiation balance of the internal combustion engine.

Preferably the second temperature is determined by reading a temperature value from an engine characteristics map at least according to the first pressure and according to the first temperature of the fuel. Determining the second temperature can generally also take into account a time-dependent transient behavior. Engine characteristics maps offer the possibility of quickly obtaining the second temperature in order to determine rapidly therefrom the resulting duration of injection. However, calculating the second associated temperature value with the aid of a mathematical function by specifying the first pressure and the first temperature would be time-consuming and could lead to an increase in the control cycle time.

It is assumed as an approximation that the temperature of the fuel in the fuel pressure accumulator corresponds to the temperature of the injected fuel. In the injection valve, however, the temperature of the fuel can be affected by many parameters. For example, the non-injected fuel loses pressure while still in the injection valve to such an extent that this fuel is heated and the temperature of the components in the injection valve increases. As a result the fuel to be injected can have a higher temperature than the fuel in the fuel pressure accumulator. For this reason the capacity of the piezo actuator is measured and a third temperature of the piezo actuator is determined from the capacity and the first pressure. The third temperature is then taken into account when the second temperature of the fuel to be injected is determined.

According to a further aspect of the present invention, an injection system is provided with an injection valve which comprises a piezo actuator. Fuel is supplied at a pressure to the injection valve from a fuel pressure accumulator. The injection system comprises a control unit to adjust the duration of injection of the injection valve, so the amount of fuel injected is determined. The injection valve discharges the non-injected fuel to a leakage line. The control unit is connected to a temperature measuring unit for measuring the temperature of the fuel in the leakage line and to a pressure measuring unit for measuring the pressure in the fuel pressure accumulator. The control unit determines a temperature of the fuel in the injection valve and which is to be injected according to a function from the temperature of the fuel in the leakage line and from the pressure in the fuel pressure accumulator. The injection time is set by the control unit as a function of the temperature of the fuel to be injected.

The injection system according to the invention has the advantage that no temperature sensor needs to be provided in the fuel pressure accumulator and/or the injection valve, but instead the temperature merely has to be measured by means of the temperature measuring unit in the leakage line. This allows temperature measuring units of simple construction to be used, as said temperature measuring units do not have to withstand high pressure. In addition, the life of the temperature sensor can be increased significantly, since the ambient conditions in the leakage flow are considerably less damaging than the ambient conditions in the fuel pressure accumulator and/or in the injection valve.

BRIEF DESCRIPTION OF THE DRAWINGS

The invention will be described in more detail below with reference to the accompanying drawings, in which.

DETAILED DESCRIPTION

Figure 1:
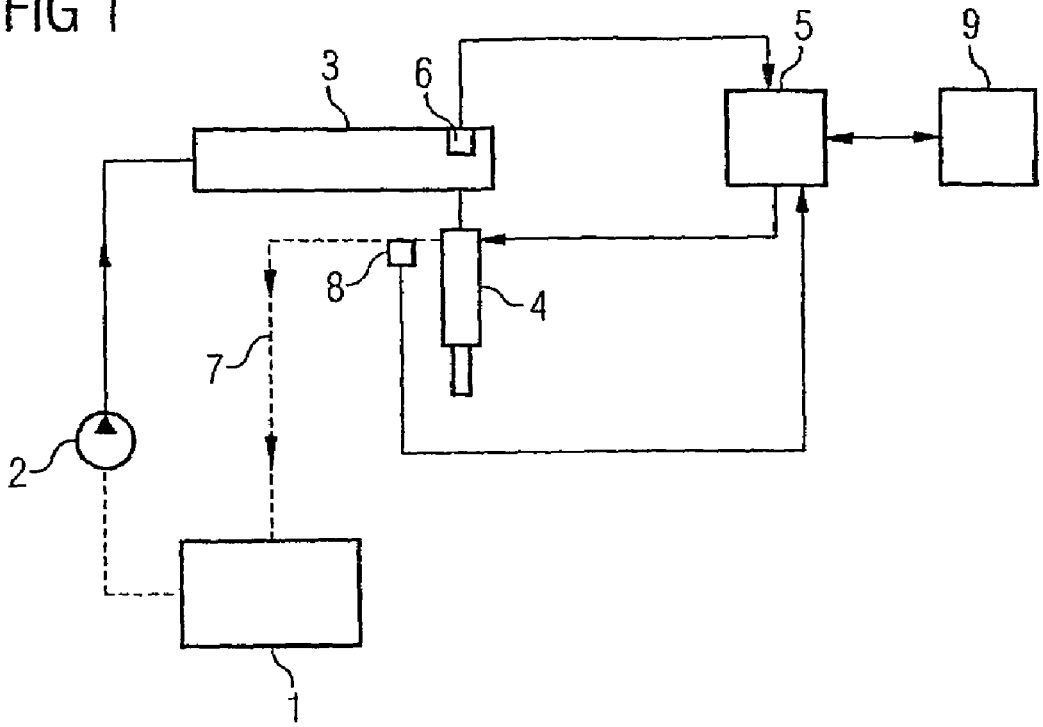
FIG. 1 is a block diagram of an injection system according to the invention.

A block diagram is shown in FIG. 1 to illustrate the injection system according to the invention. Fuel is supplied from a fuel tank 1 to a high pressure pump 2 which conveys pressurized fuel into a fuel pressure accumulator 3. The fuel pressure accumulator 3 supplies fuel at high pressure to an injection valve 4. By controlled opening and closing of the injection valve 4, fuel can thus be injected from the fuel pressure accumulator 3 into a combustion chamber (not shown).

The injection valve 4 is additionally connected to a control unit 5 which selects the duration of fuel injection and the stroke of a piezo actuator (not shown) located in the injection valve 4. The control unit 5 measures the pressure in the fuel pressure accumulator 3 by means of a pressure sensor 6 which is connected to the control unit 5 and arranged in the fuel pressure accumulator 3. Similarly, the temperature in a leakage line 7 which leads from the injection valve 4 into the fuel tank 1 is measured by the control unit 5 via a temperature sensor 8.

The leakage line 7 is used to divert the control fuel flow produced by the switching process and possible continuous leakages occurring back into the fuel tank 1 in order to be able to collect fuel for the next injection process. The fuel flows in the leakage line 7 back into the fuel tank 1 essentially without additional pressure effect, i.e. under atmospheric pressure.

The control unit 5 determines the temperature difference between the temperature of the fuel in the leakage line 7 and the fuel in the fuel pressure accumulator 3 from the pressure difference between the fuel pressure in the fuel pressure accumulator 3 and atmospheric pressure. In this connection it is assumed as an approximation therefrom that in the first instance the temperature of the fuel in the fuel pressure accumulator 3 essentially corresponds to the temperature of the injected fuel.

The increase in temperature between the fuel pressure accumulator 3 and the leakage line 7 takes place according to the laws of physics where, in fluids, a reduction in pressure leads to a corresponding increase in temperature. In order to determine the corresponding temperature of the fuel in the injection valve 4 from the measured variables—pressure in the fuel pressure accumulator and temperature in the leakage line 7—the control unit 5 accesses a memory unit 9 in which a lookup table is stored. For possible pressures P in the fuel pressure accumulator, the lookup table allows a corresponding temperature difference ΔT between the fuel temperature in the fuel pressure accumulator and in the leakage line 7 to be determined. By means of the temperature difference, the temperature of the fuel in the fuel pressure accumulator 3 can be determined from the temperature of the fuel in the leakage line 7. The temperature of the fuel can be assumed approximately to be equivalent to the temperature of the injected fuel.

In order to establish the temperature of the injected fuel more accurately, the flow rates of the fuel flow in the injection valve, the injection amount and the leakage flow in the leakage line 7 are also taken into account as parameters in the lookup table stored in the memory unit 9. The flow rates depend on the number of injection processes, the injection amount, the speed of the internal combustion engine and component characteristics and tolerances. These factors affect the temperature of the injected fuel, with the result that the temperature in the injection valve 4 is essentially somewhat higher than the temperature of the fuel in the fuel pressure accumulator 3. In addition, the ambient temperature, the engine temperature and other external factors which affect the heat radiation balance play a not insignificant role.

Therefore, it can be provided in the memory unit 9 that the corresponding aforementioned parameters are taken into account in the lookup table in order to determine therefrom the temperature difference between the fuel in the leakage line 7 and the fuel which is located in the injection valve. As the temperature of the fuel to be injected, located in the injection valve, is important for an accurate adjustment of the injection time and the stroke of the piezo actuator in the injection valve, the aforementioned factors should be taken into account as far as possible in the lookup table. Said factors are therefore stored in the memory unit 9 as a plurality of records, so that the temperature difference can be determined as a function of one or more of the aforementioned parameters and as a function of the pressure in the fuel pressure accumulator 3.

Figure 2:
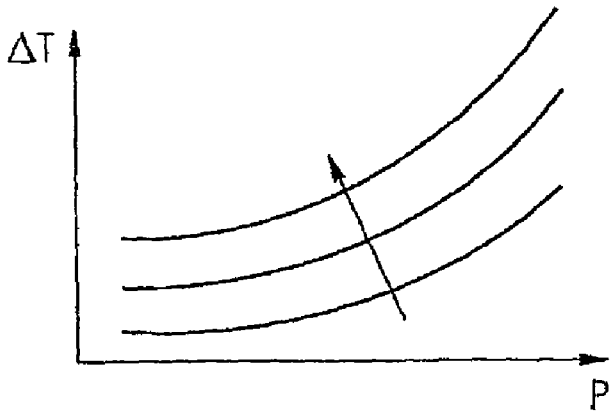
FIG. 2 shows the function for representing the dependence of the temperature difference between the fuel in the leakage line and the fuel in the fuel pressure accumulator on the pressure of the fuel in the fuel pressure accumulator.

In the diagram according to FIG. 2, the dependence of the pressure in the fuel pressure accumulator on the temperature difference ΔT is represented as a function of the cited parameters (shown by the arrow).

A further possibility for obtaining more accurate information on the temperature of the fuel in the injection valve 4 is that the capacity of the piezo actuator (not shown) of the injection valve 4 is measured by means of the control unit 5. Since the capacity of the piezo actuator is dependent in a defined manner on the temperature and on the force exerted on the piezo actuator, it is possible to determine the temperature of the piezo actuator when the pressure in the fuel pressure accumulator, which exerts a force on the piezo actuator pre-determined by the construction of the injection valve, is known. As the piezo actuator is disposed in immediate proximity to the fuel to be injected, its temperature can also be used to obtain an approximation of the determined fuel temperature to the temperature of the injected fuel.

By determining the temperature of the fuel in the leakage line 7, it is generally possible to make deductions about the temperature of the fuel in various parts of the injection system.

What is claimed is:

1. A method for adjusting the duration of fuel injection through an injection valve (4) as a function of the temperature of the injected fuel, the method comprising the steps of:

in an operational mode, injecting fuel by the injection valve (4) into a combustion chamber and discharging non-injected fuel as a leakage flow, wherein fuel is supplied to the injection valve (4) at a first high pressure, measuring a first temperature of the fuel in the leakage flow and the pressure of the fuel in the fuel pressure accumulator (3), determining a second temperature of the fuel in the injection valve (4) which is to be injected according to a function with the first temperature of the fuel in the leakage flow and the first pressure, adjusting the duration of injection as a function of the second temperature.

2. A method according to claim 1, wherein the second temperature is determined as a function of at least one of the further factors from the group consisting of:

speed of an internal combustion engine into which the injection valve is introduced;

amount of injected fuel;

number of injections;

time-dependent transient behavior of the temperature;

coolant temperature of the internal combustion engine;

ambient temperature; and heat radiation balance of the internal combustion engine.

3. A method according to claim 1, wherein the second temperature is determined by reading a temperature value from an engine characteristics map at least according to the first pressure and according to the first temperature of the fuel.

4. A method according to claim 1, wherein the capacity of the piezo actuator is measured, wherein a third temperature of the piezo actuator is determined from the capacity and the first pressure, wherein the third temperature is taken into account when the second temperature is determined.

5. An injection system having an injection valve (4), the system comprising:

a piezo actuator to which fuel is supplied at a pressure from a fuel pressure accumulator (3), and a control unit (5) for adjusting the duration of injection of the injection valve (4), so that the amount of fuel injected is determined, with the injection valve (4) discharging non-injected fuel to a leakage line (7), wherein the control unit (5) is connected to a temperature measuring unit (8) for measuring the temperature of the fuel in the leakage line (7) and to a pressure measuring unit (6) for measuring the pressure in the fuel pressure accumulator (3), wherein the control unit (5) determines a temperature of the fuel in the injection valve (4) which is to be injected according to a function with the temperature of the fuel in the leakage line (7) and with the pressure in the fuel pressure accumulator (3) and the duration of injection is set as a function of the temperature of the fuel to be injected.

6. A system according to claim 5, wherein the second temperature is determined as a function of at least one of the factors from the group consisting of:

speed of an internal combustion engine into which the injection valve is introduced;

amount of injected fuel;

number of injections;

time-dependent transient behavior of the temperature;

coolant temperature of the internal combustion engine;

ambient temperature; and heat radiation balance of the internal combustion engine.

7. A system according to claim 5, wherein the second temperature is determined by reading a temperature value from an engine characteristics map at least according to the first pressure and according to the first temperature of the fuel.

8. A system according to claim 5, wherein the capacity of the piezo actuator is measured, wherein a third temperature of the piezo actuator is determined from the capacity and the first pressure, wherein the third temperature is taken into account when the second temperature is determined.

9. A method for adjusting the duration of fuel injection through an injection valve, the method comprising the steps of:

providing fuel at a first high pressure, injecting said provided fuel by the injection valve (4) into a combustion chamber and discharging non-injected fuel as a leakage flow, measuring a first temperature of the fuel in the leakage flow and the pressure of the fuel in the fuel pressure accumulator (3), determining a second temperature of the fuel in the injection valve (4) by means of the first temperature of the fuel in the leakage flow and the first pressure, adjusting the duration of injection as a function of the second temperature.

10. A method according to claim 9, wherein the second temperature is determined by at least one of the further factors from the group consisting of:

speed of an internal combustion engine into which the injection valve is introduced;

amount of injected fuel;

number of injections;

time-dependent transient behavior of the temperature;

coolant temperature of the internal combustion engine;

ambient temperature; and heat radiation balance of the internal combustion engine.

11. A method according to claim 9, wherein the second temperature is determined by reading a temperature value from an engine characteristics map at least according to the first pressure and according to the first temperature of the fuel.

12. A method according to claim 9, wherein the capacity of the piezo actuator is measured, wherein a third temperature of the piezo actuator is determined from the capacity and the first pressure, wherein the third temperature is taken into account when the second temperature is determined.

* * * * *

UNITED STATES PATENT AND TRADEMARK OFFICE

CERTIFICATE OF CORRECTION

PATENT NO. : 7,082,928 B2
APPLICATION NO. : 11/255276
DATED : August 1, 2006
INVENTOR(S) : Jurgen Fritsch et al.

It is certified that error appears in the above-identified patent and that said Letters Patent is hereby corrected as shown below:

Title page, insert --Foreign Application Priority Data item (30):

April 24, 2003 (DE) 103 18 647--

Signed and Sealed this

Nineteenth Day of December, 2006

JON W. DUDAS
*Director of the United States Patent and Trademark Office*